US009127845B2

(12) United States Patent
Peterson

(10) Patent No.: US 9,127,845 B2
(45) Date of Patent: Sep. 8, 2015

(54) ELECTRIC FIREPLACE WITH MOVEABLE DISPLAY

(71) Applicant: FEBO LIMITED, INC., Danville, CA (US)

(72) Inventor: Richard Peterson, Incline Village, NV (US)

(73) Assignee: FEBO LIMITED, INC., Danville, CA (US)

( * ) Notice: Subject to any disclaimer, the term of this patent is extended or adjusted under 35 U.S.C. 154(b) by 55 days.

(21) Appl. No.: 13/860,303

(22) Filed: Apr. 10, 2013

(65) Prior Publication Data

US 2014/0305013 A1 Oct. 16, 2014

(51) Int. Cl.

| | |
|---|---|
| ***F24C 7/00*** | (2006.01) |
| ***F24C 7/08*** | (2006.01) |
| *F21S 10/04* | (2006.01) |

(52) U.S. Cl.

CPC ..... *F24C 7/004* (2013.01); *F24C 7/081* (2013.01); *F21S 10/04* (2013.01)

(58) Field of Classification Search

CPC ..... F24C 7/004; F21S 10/04; G09F 19/12; F24H 3/0411; B60G 11/27; F24B 1/1808

USPC ..... 40/428; 392/348

See application file for complete search history.

(56) References Cited

U.S. PATENT DOCUMENTS

| | | | | |
|---|---|---|---|---|
| 2005/0204645 | A1* | 9/2005 | Bachinski et al. | 52/36.3 |
| 2008/0013931 | A1* | 1/2008 | Bourne | 392/348 |
| 2012/0048841 | A1* | 3/2012 | Asofsky et al. | 219/201 |

FOREIGN PATENT DOCUMENTS

| | | | |
|---|---|---|---|
| CN | 202647969 U | * | 1/2013 |
| WO | WO 2014005389 | * | 1/2014 |

* cited by examiner

*Primary Examiner* — Casandra Davis

(74) *Attorney, Agent, or Firm* — Heslin Rothenberg Farley & Mesiti P.C.

(57) ABSTRACT

An electric fireplace with a simulated fire generator within a viewing area of the housing and a controller electrically coupled to the housing to control one or more functions of the electric fireplace and a heater. A display screen for displaying the operative functions of the electric fireplace and heater attached to the housing and configured to move between a view position and a non-view position in response to the controller. By activating or adjusting the controller, the display screen moves from a non-view position to a view position in response to the controller. In the view position, the display screen may be within the viewing area of the housing for viewing information depicted thereon.

20 Claims, 6 Drawing Sheets

ELECTRIC FIREPLACE WITH MOVEABLE DISPLAY

FIELD OF THE INVENTION

The present invention relates to an electric fireplace for simulating a wood burning fireplace, and in particular to an electric fireplace having a moveable display.

BACKGROUND OF THE INVENTION

An electric fireplace is useable to heat and simulate a wood burning fire in the room of a building. An electric fireplace is typically designed to look like a traditional wood burning fireplace, but does not actually burn wood. Light bulbs, including for example, LED light bulbs illuminate a reflective medium such as metal to generate a flickering flame image. The flickering flame image is displayed in a viewing area of the electric fireplace. Within the viewing area are artificial logs which together with the flickering flame images generate the appearance of burning logs, thereby closely simulating the flames of a wood burning fireplace. The electric fireplace may include an integrated electric heater which blows hot air from the heater to help heat a room. A controller is typically used to control the intensity of the heat generated by the electric heater, the fan speed of a blower within the heater, and activate and/or control the intensity of the light source within the electric fireplace to generate the simulated flame within the viewing area. One such electric fireplace is disclosed in U.S. Patent Publication No. US2009-0080871 published on Mar. 26, 2009, the specification of which is incorporated herein by reference in its entirety. In such types of fireplaces, a control panel may be located on the electric fireplace and displayed at all times. The control panel may also display particular indicia or information. The control panel will thus take up space on the fireplace, thereby affecting aesthetics.

SUMMARY OF THE INVENTION

In order to improve the user interface with an electric fireplace and aesthetics, an electric fireplace in accordance with the principles of the present invention includes a display screen which moves into the viewing area of the fireplace. The display screen may then return to a non-view, e.g., hidden position after a preselected period of time. The display screen may be controlled by a control panel which when activated or adjusted causes the display screen to move from a non-view position to a view position which can be seen by a user.

In one aspect, the invention includes an electric fireplace comprising a housing which includes an electric fireplace, a heater, a simulated fire generator within the viewing area of the housing, a controller electrically coupled to the housing, and a display screen for displaying the operative functions of the electric fireplace and heater. The controller is configured to control one or more functions of the electric fireplace and heater. The display screen is attached to the housing and configured to move from a non-view position to a view position in response to the controller. The display screen may fold into a non-view position and then unfold or flip down into a view position.

The controller may control at least one of simulated flame intensity, simulated fire time, heater temperature, power activation, and child lock functions. The display screen may display at least one of the status of simulated flame intensity, simulated fire time, heater temperature, and child lock functions. The display screen may move by unfolding into the view position in response to the controller being activated or one or more functions adjusted. The display screen may fold into the non-view position within a preselected period of time after a function is activated or adjusted. The display screen may unfold into the viewing area of the housing. The controller may include a controller interface attached to the housing and/or a remote control interface.

In another aspect, the invention includes a method of providing the electric fireplace in accordance with the principles of the present invention including as previously described.

BRIEF DESCRIPTION OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

The aspects of the present invention and certain features, advantages and details thereof, are explained and more fully below with reference to the non-limiting embodiments illustrated in the accompanying drawings. Descriptions of well known materials, fabrication tools, processing techniques, etc., are omitted so as to not unnecessarily obscure the invention in detail. It should be understood, however, that the detailed description and the specific examples, while indicating embodiments of the invention, are given by way of illustration only, and are not by way of limitation, various substitutions, modifications, additions and/or arrangements within the spirit and/or scope of the underlying inventive concepts will be apparent to those skilled in the art from this disclosure.

The references made below are to the drawings, which are not necessarily drawn to scale for ease of understanding, wherein the same reference numbers used throughout different figures designate the same or similar components.

Figure 1:
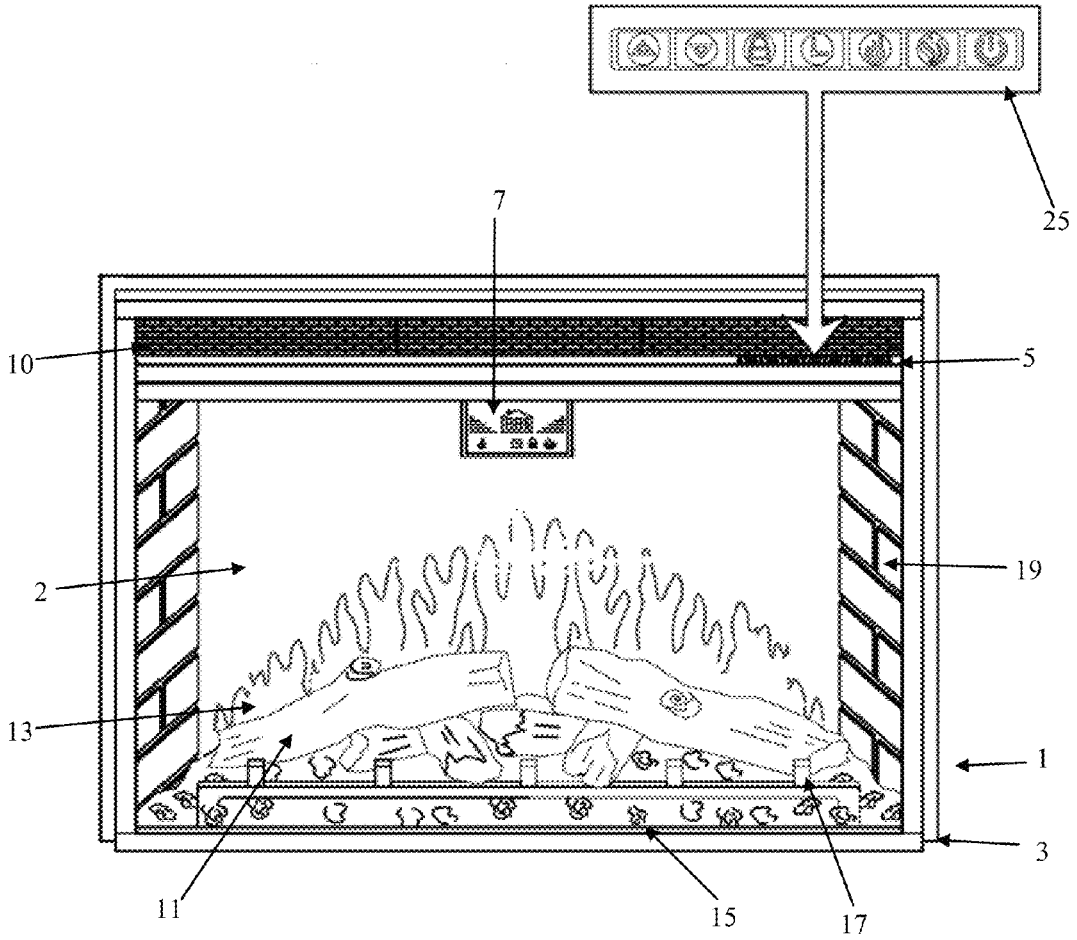
FIG. 1 depicts a front view of an electric fireplace with a folding flip down display in the view position.
Figure 2:
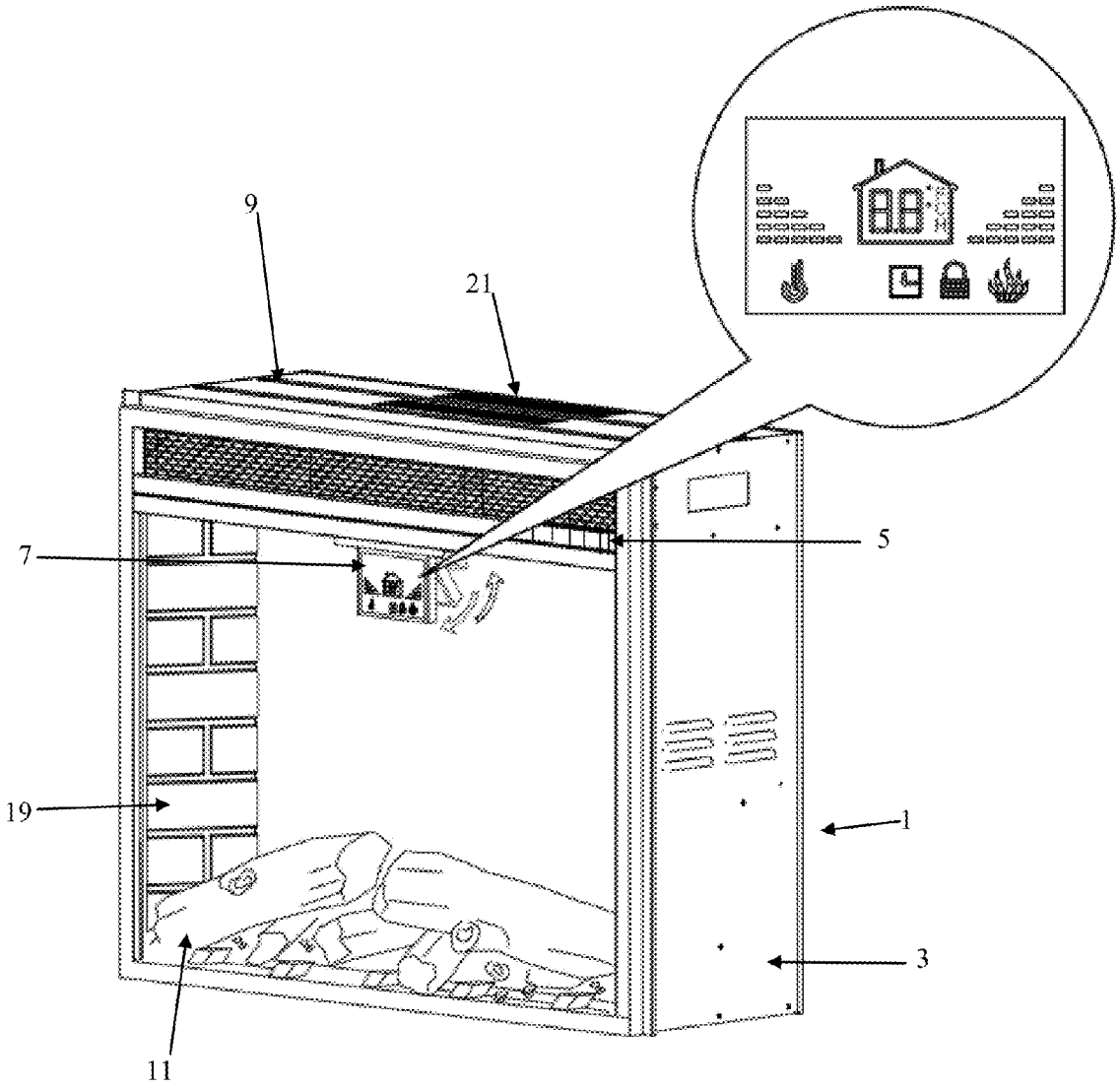
FIG. 2 depicts an isometric view of the electric fireplace the type set forth in FIG. 1.

Referring now to FIG. 1, an electric fireplace in accordance with the principles of the present invention is shown from a front view. FIG. 2 shows an isometric view of the fireplace depicted in FIG. 1. Referring now to FIGS. 1 and 2, the fireplace 1 includes a viewing area 2 within which a simulated fire is displayed. The viewing area 2 includes a background where images of a simulated flame 13 may be displayed. The simulated flame is depicted as emanating from a series of simulated logs 11 which are placed on top of an actual or simulated grate 17. Simulated embers or coals 15 are also used to enhance the effect of the simulated fire. The simulated fire may be generated as described in U.S. Patent Publication No. US/2009-0080871 published on Mar. 26, 2009, which is incorporated herein by reference in its entirety. The electric fireplace is contained within a housing 3. The housing 3 includes a controller 5 which controls the functions of the electric fireplace. A display screen 7 is mounted in a foldable display unit near the top of the fireplace adjacent the top of the viewing area 2. As shown in FIG. 2, the display screen 7 moves between a folded non-view position to a non-folded view position (as shown in FIG. 1). In the view position, the display screen 7 is moved, for example, into the viewing area where it can be viewed by a person looking into the viewing area of the fireplace. In the non-view position, the display screen 7 is moved back where it is invisible to a person positioned in front of the fireplace in a normal viewing position. The electric fireplace also includes a heater 9 with heat discharge vents 10, which discharge heated air. The heater 9 is located on the top portion of the housing 3 of the electric fireplace.

As shown in FIG. 2, the heater 9 includes an intake vent 21. Air is sucked into the intake vent 21 by a blower (not shown) whereby the air is heated by the heater 9 and blown out the discharge vents 10 located at the top of the fireplace above the viewing area. Accordingly, the electric fireplace provides heated air to the environment or room within which the electric fireplace is installed. Within the viewing area of the electric fireplace, on the sides thereof, are actual or simulated, fire bricks 19. When activated, the electric fireplace 1 through the use of reflective light creates an image of simulated flames 13 providing an image of a real fire. And, together with the activation of the heater 9, the electric fireplace blows hot air into the room, thereby providing both the look and feel of a real fire. The lighting techniques useable to generate a simulated fire image or flames, in one aspect, are disclosed in U.S. Patent Publication No. US/2009-008071. However, other techniques may be used to create a simulated flame without departing from the scope of the invention.

Figure 3:
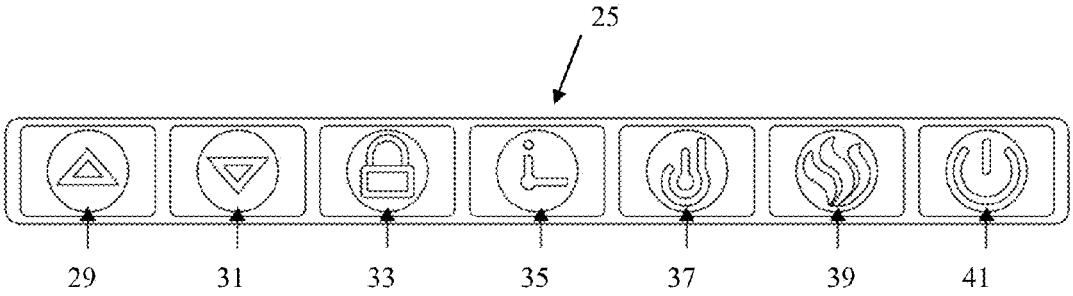
FIG. 3 depicts the graphical user interface of a control panel of a controller located within the electric fireplace of the type shown in FIG. 1 and FIG. 2.

The electric fireplace 1 includes numerous different functions, which are controlled by the controller 5. The controller 5 may include a control panel 25 as shown in FIG. 3. The controller 5, together with the control panel 25, controls functions of the electric fireplace including power activation, simulated flame intensity, simulated fire time, heater temperature, heater activation, and heater time, as well as a child lock function. The control panel 25 may include an up button 29 (or other type of adjustment means) a down button 31, (or other type of adjustment means), a child lock activation function button 33 (or other type of activation means), a timer activation or setting button 35 (or other type of activation means), a heater activation or button 37 (or other type of activation means), and a flame activation button 39 (or other type of activation means), and a power activation button 41 (or other means). Operating the various buttons on the control display 25 the controller 5 will operate the functions of the electric fireplace 1 including activating the power of the electric fireplace by button 41, activating the flame function using button 39 to create a simulated flame, activating the heater function to begin blowing hot air using button 37, activating a timer to allow the electric fireplace to operate for a particular period of time using button 35, and activating the child lock features using button 33. The buttons may also, if pressed while a particular function is activating, deactivate the particular function. The up button 29 and down button 31 also may control, by raising and lowering, respectively, the heater levels, timer setting times, as well as the simulated flame intensity levels.

Figure 4:
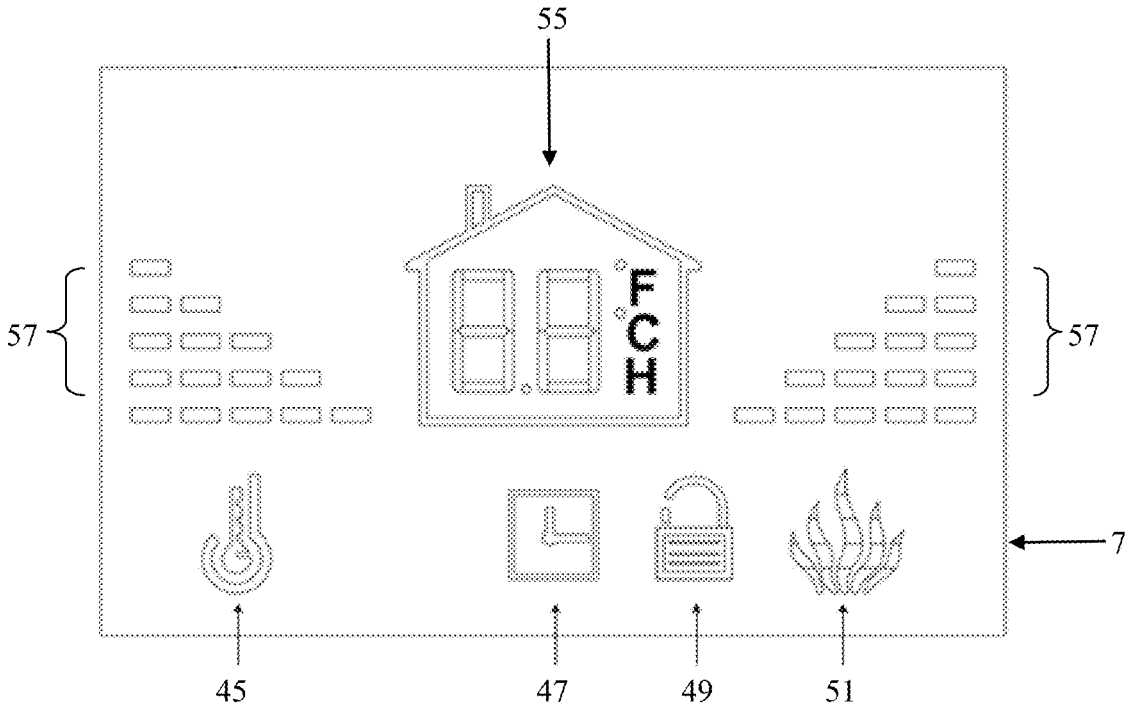
FIG. 4 depicts a graphical presentation of the face of a display screen useable with the electric fireplace of the type shown in FIG. 1 and FIG. 2.
Figure 6:
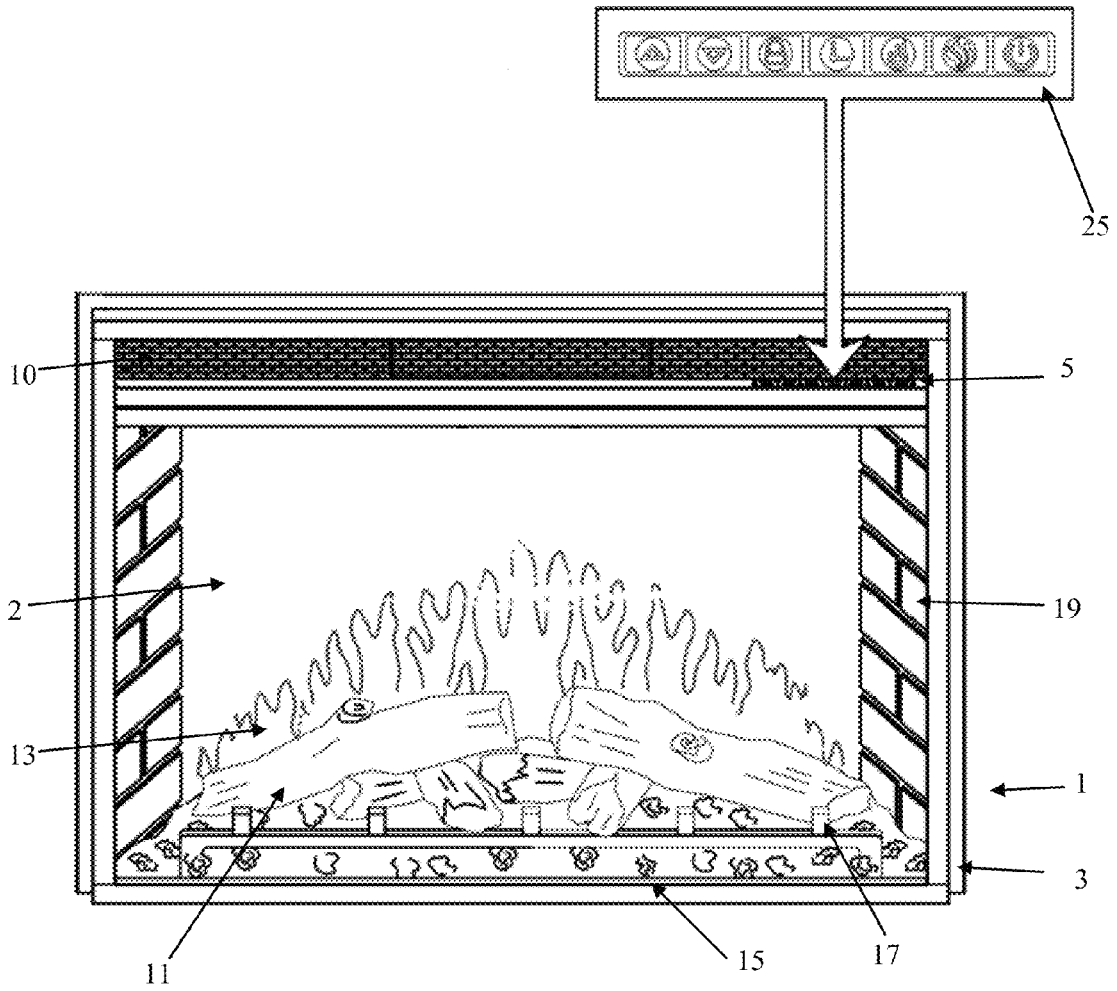
FIG. 6 depicts the electric fireplace of FIG. 1 with the display screen folded into the non-view position and thus not within the viewing area of the electric fireplace.

Referring now to FIGS. 1, 2 and 4, the electric fireplace includes a display screen 7. The display screen is moveable between, for example, an unfolded position, shown in FIG. 1, to, for example, a folded position shown in FIG. 6. In the unfolded position, as shown in FIG. 1, the display screen drops down from the top of the inside of the housing 3 of the electric fireplace 1 into the viewing area 2 to be easily seen by a user or other person. Although the screen may be folded or unfolded by, for example, pivoting on a hinge, the display may be configured to move in any other different way such as translating between retracted and unretracted position for viewing. The display screen may be moved by any known devices such as electric motors, springs, pistons, and/or linear actuators. The display screen will contain information regarding the operative functions of the electric fireplace 1 to be read by the user or other person. When in the folded position, the display screen 7 will fold up into the bottom portion of the housing 3 where the heater 9 is mounted and thus out of the view area, as is shown in FIG. 6.

Referring now to FIG. 4, a schematic representation of the display layout 27 screen useable in the electric fireplace 1 is shown. The display screen is preferably an LED display screen of the type where LEDs will display graphical images. The display screen is capable of generating images representative of various operative functions of the fireplace. For example, a graphical image of a thermometer 45, timer 47, lock 49, and flame 51 are located towards the bottom of the display screen. When each of the aforementioned heater, timer, child lock function, and simulated flame functions are activated, the respective image is illuminated via the display screen, for example, by illuminating the LEDs proximate the image. By further example, when the heater 9 is operative, the thermometer image 45 will illuminate. When the timer function is operative, the timer image 47 will illuminate. When the child lock function is operative, the lock image 49 will illuminate. And, when the simulated flame function is operative, the flame image 51 will illuminate. Thus, when any of the aforementioned functions are activated using the control panel and controller, the associated image on the display screen will illuminate.

Located on the display screen 7 towards the center thereof, is an image of, for example, a house 53 with a numerical display 55 thereby. The numerical display 55 will display the temperature function setting of the heater and specifically, the preselected temperature setting for the heater. For example, if the temperature is set by a user using the control panel and controller to a desired setting, that setting will display in the numerical image. The numerical display 55 is capable of displaying the temperature in either Fahrenheit or Celsius degrees. The numerical display 55 is also configured to display the timer function setting. For example, if the timer function is activated and adjusted to a preselected timer setting, the selected time will be displayed in the numerical display as a numerical image. For example, if the timer is selected for one hour, the numerical display 55 of "1" will be shown on the numerical display image. Also located on the display screen are flame level selection bars 57. These bars are also illuminated, for example, by LEDs within or behind the display screen. The flame level display is oriented into two sets of rows and columns. The first row containing five bars, the second row, four, the third row, three, the fourth row, two and the fifth row, one. Each set of flame level bars forms a triangle. If the simulated flame level is adjusted to its high setting, each of the rows of flame level bars will be illuminated so that the shape of a substantially full triangle is displayed, depicting a high flame level. If the flame adjustment level is decreased, the flame level bars will deilluminate for each level of decrease. There are five total flame adjustment levels representing five flame level intensities.

Figure 5:
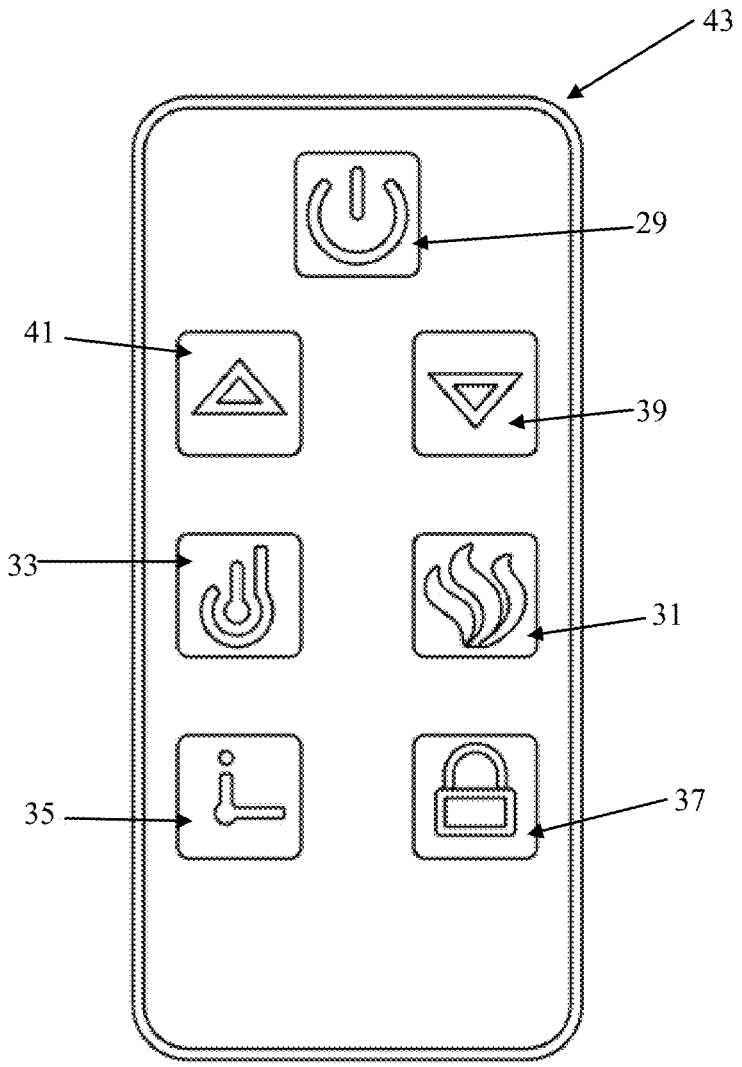
FIG. 5 depicts a remote control unit used to communicate remotely with the controller of the electric fireplace of the type shown in FIG. 1 and FIG. 2.

The controller 5 may include or be in communication with a remote control unit 43, as shown in FIG. 5. The remote control unit 43 may contain a series of buttons which are identical in function to the series of buttons shown on the control panel 25 located on the fireplace 1. With the remote control unit 43, a user may operate the controller to control the functions of the electric fireplace 1 which will be shown on the display screen when operative. The remote control unit 43 and controller 5 may communicate between one another using any suitable known wireless signal processing technology, including but not limited to infrared technology. Accordingly, the remote control unit 43 contains power on/off button 29, an up adjustment button 41, a down adjustment button 41, a heater function on/off button 33, a flame on/off button 31, a timer on/off button 35, and a child lock function on/off button 37. In lieu of actual buttons, other activation means may be implemented into the remote control unit 43.

Referring now to the drawings, operation of the electric fireplace by a user using either the control panel 5 located on the fireplace 1, or the remote control unit 43 will now be described. Since the remote control unit 43 and control panel 25 control identical functions, operation of the electric fireplace 1 may be achieved using either. To activate power to the electric fireplace, the power activation button 29 be activated by contact thereof. To activate power, the power activation button 29 on either the controller, control panel 25 or the remote control unit 43 may be depressed. While the power is activated, pressing of the power activation button 29 will then shut the power to the electric fireplace off. To activate the flame, the simulated flame activation button may be depressed 31. When depressed, the electric fireplace 1 within its viewing area will display a simulated flame coming from the simulated logs and glowing embers. The intensity of the flame may be adjusted either to an up or down level. Up will raise the simulated intensity of the flame, and down will lower the simulated intensity of the flame. To adjust the simulated intensity of the flame down, the down button 39 on the remote control unit 43 or control panel 25 may be depressed while the flame function is operative. To adjust the flame intensity to a higher level, the up button 41 on the control panel 25 or remote control unit 43 may be depressed while the simulated flame function is operative. Thus, to adjust the simulated flame up or down, an up or down button may be depressed, respectively, until a desired flame intensity level is achieved. The operative flame intensity level will be displayed on the display screen 7 within the viewing area of the fireplace. When the simulated flame level intensity is at its highest setting, each of the flame level bars 57 will be illuminated. When the flame level intensity is at its second highest level, the first row of the flame level bars will not be illuminated. The third highest level of flame intensity setting will result in the top two rows of the flame levels bars not being illuminated. The fifth level flame adjustment level will result in the bottom three rows of the flame level bars being illuminated. The lowest flame intensity level will result in the bottom row of the flame level bars being illuminated, while the second lowest flame intensity level will result in the bottom two rows of the flame level bars being illuminated.

To activate the heater 9 of the electric fireplace 1, the heater button 33 on the control panel 25 or remote control unit 43 may be activated by depressing either button. At this point, the electric fireplace will begin heating at a particular preselected temperature setting. By activating the up or down buttons 41, 39 on either the control panel 25 or remote control unit 43, the temperature setting may be adjusted. Typically, the highest temperature setting is 95° F. and the lowest temperature setting, 65° F. By pressing the up or down buttons, the temperature setting may be adjusted to a preselected amount, typically five degrees. Therefore, if the temperature setting is initially at 95° F., activating the temperature down button will lower the temperature setting to 90° and each additional temperature adjustment will increase or decrease the temperature setting by five degrees. The selected temperature setting corresponds to the operative heater function temperature so that the temperature of the hot air blown from the heater will achieve the desired temperature set by the user. The desired temperature will be displayed in the numerical display 55 on the display screen 7.

The electric fireplace 1 includes a timer function. The timer function may be activated by depressing the timer button 35 on the control panel 25 or the remote control unit 43. The controller 5 is programmed to include preselected timer settings or intervals, for example, 0.5 hours, 1 hour, 1.5 hours, 2 hours, and 8 hours. However, other preprogrammed timer settings may be used. The timer setting may be adjusted to a higher time by using the up button 41 on the control panel 25 or remote control unit 43. The timer setting may be adjusted to a shorter time by activating the down button 39 on either the remote control unit 43 or control panel 25. The timer function time will be displayed in the numerical display 55 on the display screen 7 of the electric fireplace 1. Once the timer function is activated, the current operative functions as inputted by a user using the control panel or remote control unit will remain activated until the selected time interval is reached. Once the preselected time interval is reached, the electric fireplace 1 will shut down and power will be deactivated. When the timer function is activated, the timer display image 47 on the display screen will be illuminated. The remaining time left on the preselected timer function duration will be displayed (or a representative time period rounded to the nearest tenth of an hour or more) will be displayed in the numerical display image 55 on the display screen 7.

The electric fireplace 1 includes a child lock function. When the child lock function is activated, all other functions of the electric fireplace are automatically disabled. The functions may be reactivated by depressing the child lock button 37 for a preselected period of time, for example, six seconds to deactivate the child lock function. The child lock function may be activated or deactivated using the child lock function button 37 on the control panel 25 or remote control unit 43. When the child lock function is activated, the child lock image 49 on the display screen will be illuminated.

To adjust a particular function setting to a higher or lower level, the user will depress the particular function button 35, 37, 39 on either the control panel 25 or remote control unit 43, then press the up or down button 41, 39 to adjust the level either upwards or downwards, respectively. For example, to adjust the simulated flame intensity the flame intensity button 31 should be depressed and then the up or down buttons depressed to adjust the setting. Similarly to adjust the heater temperature, the heater button 33 on the control panel or remote control unit should be depressed and the up or down buttons on the remote control unit or control panel adjusted upwardly or downwardly. Similarly to adjust the timer function setting, the timer button 35 on the remote control unit or control panel should be depressed and then the up or down button depressed to increase or decrease the time, respectively.

The display screen 7 is configured to move from its non-view position to its view position upon activation of preselected buttons on the control panel or remote control unit. In the illustrated examples, the display screen 7 moves by unfolding, e.g., flips down. However, other movements may be implemented to move the display screen 7. Also, the controller may be programmed to cause the display screen to unfold when heater button 33, flame intensity button 31, timer setting button 35, and/or child lock function 37 buttons are pressed. Furthermore, the controller may be programmed to unfold the display screen 7 when the power on/off button 29 is activated and power is initialized to the electric fireplace 1. The controller may be preprogrammed so that any one control function or combination control functions, when activated, will unfold the display screen into its view position. Preferably, the display unit will unfold into its view position when any button on the control panel or display screen is activated, or any function of the electric fireplace is adjusted using the up and/or down button. After the display screen unfolds into its view position (as shown in FIG. 2), the display screen may automatically fold back into its non-view position (as shown in FIG. 6) after any desired period of time, but preferably between 10-30 seconds. For example, after a period of time, e.g., 30 seconds, the controller may be programmed to fold the display screen 7 back to the non-view position. The display screen is operatively connected to a motor which, when signaled by the controller, will cause the display screen to fold or unfold. Other, well known mechanisms may be used to fold and/or unfold the display screen 7.

The electric fireplace, by use of its flip down display, provides the user with the ability to graphically view information regarding operative functions of the fireplace. Furthermore, the display, due to its folding features, does not permanently obscure the view of a simulated fire during operation of the fireplace. Moreover, the display screen is not permanently viewable and affixed onto the face of the fireplace outside of the fire viewing area. This configuration allows for the electric fireplace to have maximum fireplace viewing area along with maximum heater vent discharge area. Because the flip down display folds up into its non-view position after a preselected period of time, for example, about 30 seconds, the display remains obscured from view and essentially hidden during normal operation of the fireplace so that the fireplace provides the aesthetic appearance of a normal operating wood fireplace.

The corresponding structures, materials, acts and equivalence of all means or steps plus function elements in the claims below, if any, are intended to include any structure, material or acts for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments depicted herein were chosen and described in order to best explain the principles of one or more aspects of the invention and the practical application, and to enable others of ordinary skill in the art to understand one or more aspects of the invention for various embodiments with various modifications as are suited to the particular use contemplated.

What is claimed is:

1. An electric fireplace comprising:

a housing comprising an electric fireplace and heater;

a simulated fire generator within a viewing area of the housing;

a controller electrically coupled to the housing, the controller configured to control one or more functions of the electric fireplace and heater;

a display screen for displaying operative functions of said electric fireplace and heater; and the display screen being attached to the housing and configured to move from a non-view position to a view position in response to the controller.

2. The electric fireplace of claim 1 wherein the heater is located within the housing.

3. The electric fireplace of claim 2 wherein the controller controls at least one of simulated flame intensity, simulated fire time, heater temperature, power activation, and child lock functions.

4. The electric fireplace of claim 3 wherein the display screen displays at least one of the status of simulated flame intensity, simulated fire time, heater temperature, and child lock activation status.

5. The electric fireplace of claim 4 wherein the display screen moves into the view position in response to the controller being activated or one or more functions adjusted.

6. The electric fireplace of claim 5 wherein the display screen moves into the non-view position within a preselected period of time after a function is activated or adjusted by the controller.

7. The electric fireplace of claim 6 wherein the display screen unfolds into the viewing area of the housing.

8. The electric fireplace of claim 6 wherein the controller comprises a control panel interface attached to said housing.

9. The electric fireplace of claim 8 wherein the controller communicates with a remote control interface.

10. A method comprising:

providing a housing comprising an electric fireplace and heater;

providing a simulated fire generator within a viewing area of the housing;

electrically coupling a controller to the housing, the controller configured to control one or more functions of the electric fireplace and heater;

providing a display screen for displaying operative functions of the electric fireplace and heater; and attaching the display screen to the housing so as to move from a non-view position to a view position in response to the controller.

11. The method of claim 10 wherein the heater is located within said housing.

12. The method of claim 11 wherein the controller controls at least one of simulated flame intensity, simulated fire time, heater temperature, power activation, and child lock functions.

13. The method of claim 12 wherein the display screen displays at least one of the status of simulated flame intensity, simulated fire time, heater temperature, and child lock activation status.

14. The method of claim 13 wherein the display screen is configured to move into the view position when the controller is activated, or a function is activated or adjusted, by the controller.

15. The method of claim 14 wherein the display screen is configured to move into the non-view position within a preselected period of time after a controller function is activated or adjusted.

16. The method of claim 15 wherein said display screen is configured to unfold into the viewing area of the housing.

17. The method of claim 16 comprising providing a controller interface attached to the housing.

18. The method of claim 17 wherein the controller communicates with a remote control interface.

19. An electric fireplace comprising:

a housing comprising an electric fireplace and heater;

a simulated fire generator within a viewing area of the housing;

a controller electrically coupled to the housing, the controller configured to control one or more functions of the electric fireplace and heater, said functions comprising simulated flame intensity, simulated fire time, heater temperature, power activation, and child lock functions;

a display screen for displaying operative functions of the electric fireplace and heater; and the display screen being attached to the housing and configured to move from a non-view position to a view position in response to the controller being activated or one or more functions of said electric fireplace and heater adjusted using said controller.

20. The electric fireplace of claim 19 wherein the display screen displays at least one of the status of simulated flame intensity, simulated fire time, heater temperature, and child lock activation status.

* * * * *